United States Patent [19]

Köhler

[11] 4,440,266

[45] Apr. 3, 1984

[54] RACK AND PINION LIFT SYSTEM

[75] Inventor: Ulf Köhler, Skellefteå, Sweden

[73] Assignee: Linden Alimak AB, Skellefteå, Sweden

[21] Appl. No.: 381,408

[22] Filed: May 24, 1982

[30] Foreign Application Priority Data

May 26, 1981 [SE] Sweden ..... 8103312

[51] Int. Cl.[3] ..... B66B 1/06

[52] U.S. Cl. ..... 187/29 R; 187/19

[58] Field of Search ..... 187/6, 19, 29

[56] References Cited

U.S. PATENT DOCUMENTS

| | | | |
|---|---|---|---|
| 1,844,133 | 2/1932 | Maniscalco et al. | 187/29 |
| 3,878,916 | 4/1975 | White, Jr. | 187/19 X |
| 3,924,710 | 12/1975 | Shohet | 187/19 |
| 4,018,306 | 4/1977 | Lyons | 187/29 X |
| 4,029,175 | 6/1977 | Winkler | 187/29 R |
| 4,102,437 | 7/1978 | Mandel | 187/29 |
| 4,108,282 | 8/1978 | Satoh et al. | 187/29 R |
| 4,149,614 | 4/1979 | Mandel et al. | 187/29 R |
| 4,350,226 | 9/1982 | Sheehy et al. | 187/29 |

FOREIGN PATENT DOCUMENTS

| | | | |
|---|---|---|---|
| 1436743 | 5/1976 | United Kingdom . | |
| 2071613 | 9/1981 | United Kingdom | 187/19 |

*Primary Examiner*—G. Z. Rubinson
*Assistant Examiner*—W. E. Duncanson, Jr.
*Attorney, Agent, or Firm*—Curtis Ailes

[57] ABSTRACT

The invention relates to rack and pinion lifts, which include a lift car which is driven via toothed wheels by means of an electromotor along a rack carried by a lift mast, said car containing a control and maneuver unit for the electric motor with a control and maneuver button set including floor call buttons, landing based call button units being connected to said control and maneuver unit via a ground level unit from which also a power cable leads to the lift car.

In association with the lift car a sensor device is arranged to indicate passage of teeth of the rack or the toothed wheel and produce corresponding position impulses, which represent the position of the lift car.

A micro computer system is connected for receiving the position impulses and for collecting and storing call impulses from the call units and destination impulses from the button set of the control and maneuver unit, and based upon the position of the lift car ordering travel direction, retardation and stop of the lift car. Said micro computer system includes on the one hand a programmable micro computer unit in the lift car with a register for position impulse numbers corresponding to the positions of the landings, inputs for landings and outputs for controlling operation of the electric motor, on the other hand a micro computer unit scanning the call button units with respect to their state and associated with the ground level unit and communicating with the programmable micro computer unit in the lift car.

8 Claims, 3 Drawing Figures

RACK AND PINION LIFT SYSTEM

Figure 1:
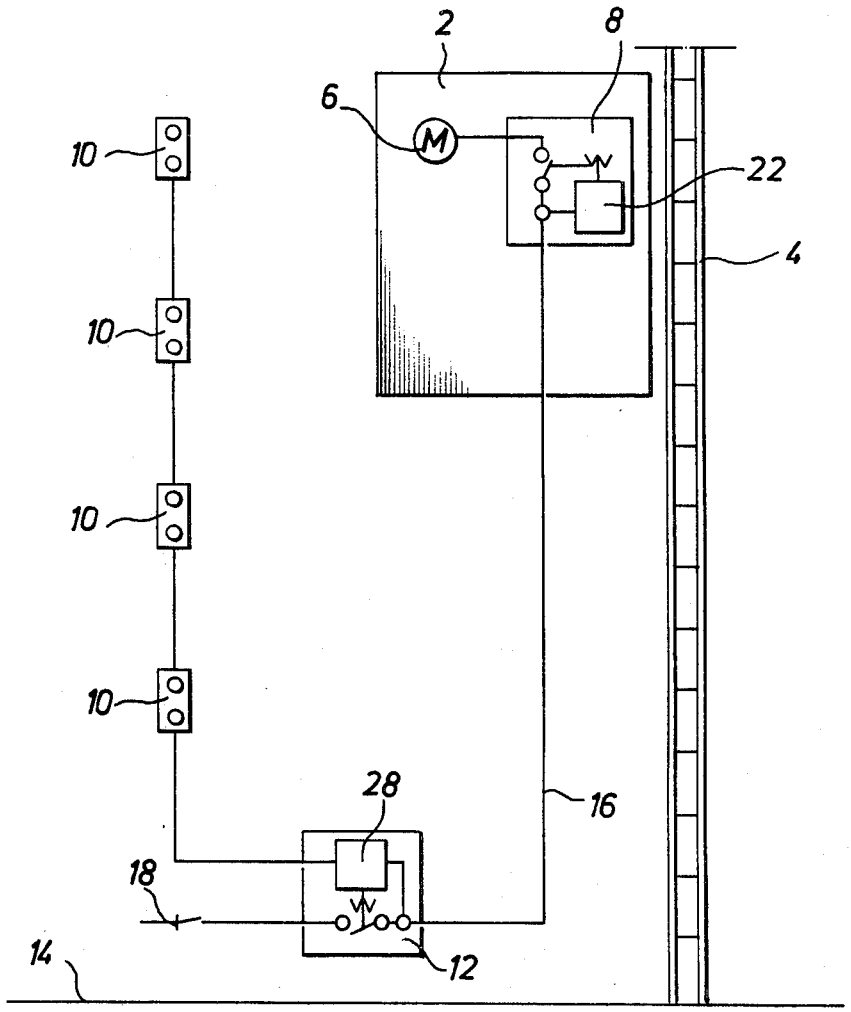

The present invention relates to a rack and pinion lift system, comprising a lift car electro motor means for driving said car along a lift mast via rack and pinion means, a control unit in said car with a control button set including floor call buttons, call button units on landings along said mast, means connecting said call button units to said control unit via a ground level unit.

Micro computer controlled floor call systems are earlier known in connection with fixed wire rope hoist systems for indoor applications, cf e.g. U.S. Pat. Nos. 4,029,175 and 4,149,614. Attempts to apply similar systems for automatic control of rack and pinion drive lifts in tough industrial environment, building sites, excavations and the similar sites meet with a number of problems. Among these problems temperature and moisture conditions varying within wide limits should be mentioned, as well as corrasive atmosphere in some cases. Power mains voltage variations often occur due to connection and disconnection of great loads and also the risk for voltage disappearance is greater than normal. The above mentioned problems can certainly in some cases be remedied by suitable choice of components, but at the same time they necessitate a far going simplification of the signal transmission and its organization in order to eliminate as many sources of error as possible because of environment.

An important demand in lift systems of the kind here intended is that they shall be flexibly adaptable in the field to varying numbers of landings and varying distances between the landings. This is a great advantage also in more fixed installations and a necessity in installation sites of the type building sites, where the number and mutual distance of the landings vary during the progress of the work.

A main object of the invention is to provide a floor call system for automatic control of rack and pinion lifts for building and industrial applications. The floor call system shall determine the direction of travel, retardations and stops based upon call and destination impulses, and considering the position of the lift car.

A further object of the invention is to provide a floor call system of the kind mentioned that allows flexible adaption, also with untrained personnel, of the system to varying number of landings and varying mutual distances between the landings at the original installation as well as during the time of use of the system.

A still further object is to facilitate the use in tough industrial environment of such a system by far reaching simplification and adaption of the system.

The above objects, as well as others, which will appear more closely from the description to follow, have been attained in that a rack and pinion lift system of the kind initially indicated comprises (A) sensor means associated with said lift car having means for sensing passage to teeth of said rack and pinion means and producing corresponding position impulses representative of the position of said lift car along said mast (B) a micro computer system comprising (a) a programmable micro computer unit in said lift car with means for receiving said position impulses, register means for position impulse numbers based upon said position impulses and representative of the positions of landings, means for collecting and storing call impulses from said call button units and destination impulses from said control button set, and output and control means for controlling operation of the electric motor as determined by received call and destination impulses.

(b) a second micro computer unit associated with said ground level unit having means for scanning said call button units with respect to their state and sending corresponding call impulses to said programmable micro computer unit.

The invention and its advantages will now be described more closely below with reference to the drawings and embodiments illustrated on these.

On the attached drawings

Figure 2:
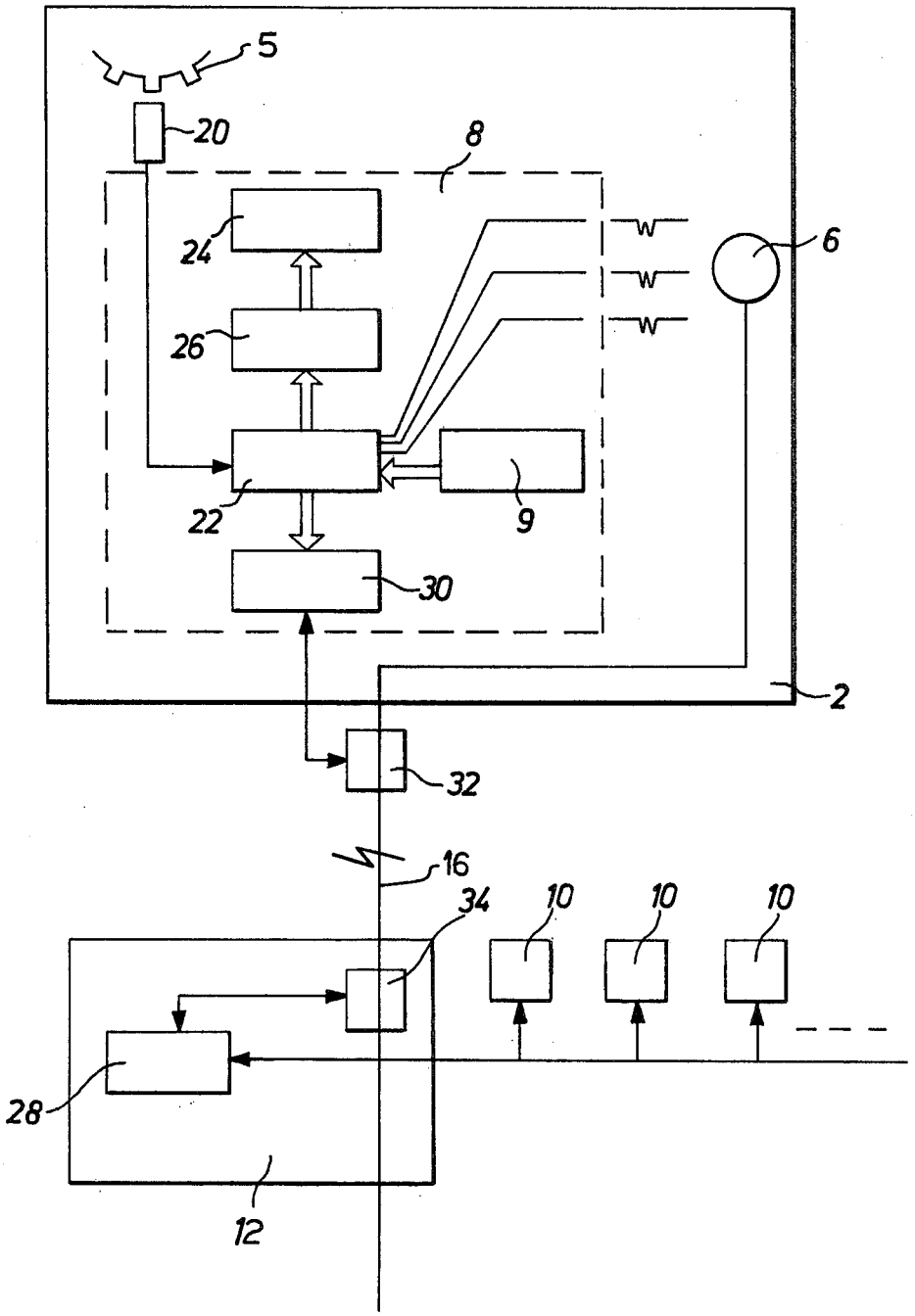
Figure 3:
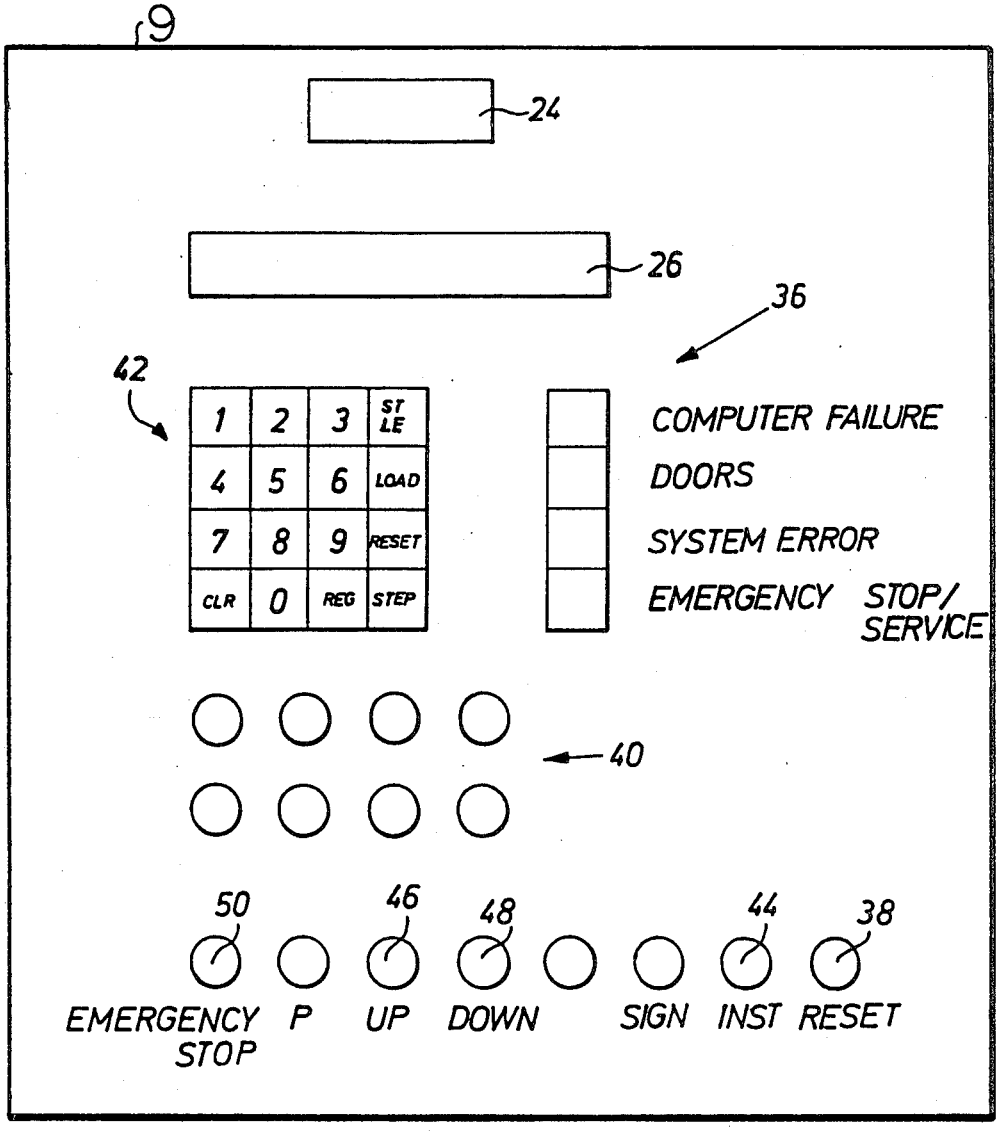

FIG. 1 very schematically illustrates a lift system of the rack and pinion drive type, in which a floor call system according to the invention is used, FIG. 2 is a likewise schematical flow chart over said system, and FIG. 3 in an elevational view shows an example of the basic arrangement of a lift car based control panel for the call system according to the invention.

In FIG. 1 a very schematically illustrated conventional rack and pinion drive lift is included with lift cage or car 2, lift mast 4 and a driving electric motor 6. The rack carried by the lift mast 4, on which the lift car 2 is movable, is not shown and neither is the gear transmission between the electric motor 6 and said rack. These components are, however, well known in a number of embodiments to the man of the art.

The lift car 2 contains a control and manoeuver unit 8 for the electric motor with a control or key board 9 (Fig. 2, Fig. 3) including i.a. destination or floor call buttons 40 (FIG. 3). Landing based call button units 10 (FIG. 1, FIG. 2) are connected to the control and manoeuver unit 8 via a ground level unit 12. The ground level in the illustrated embodiment is a ground floor 14 but can also be located on another level with respect to the lift mast 4. Between the ground level unit 12 and the lift car a power cable 16 extends. At 18 (FIG. 1) connection to the mains is indicated.

The units 8 and 12 together include a micro computer system arranged to collect and store call impulses from the call units 10 and destination impulses from the button set 40 of the control and manoeuver unit 8 and, based upon the position of the lift car, to order driving direction, retardation and stop of the lift. The stored calls and/or destinations are thereafter carried through in a selective and logical way, i.e. during travel upwards the call impulses for "up" shall be coordinated with the destination impulses so that the lift car travels from landing to landing and picks up and/or lets off passengers in a systematic way. When all calls and/or destinations for upwards travel have been carried through the direction of travel shall be changed to "down" whereafter call impulses for down are coordinated with destination impulses so that the lift starts/stops in a way corresponding to that which has been described above.

How to generally realize the system with respect to electrical connections and program lay out, to be able to carry through the above described functions, need not necessarily form part of the invention, but can be realized by the man of the art, and reference can be made to the similar systems which i.a. appear from the U.S. patent specifications mentioned by way of introduction. Here shall the solution to the problems appearing in connection with adaption of such a system to rack and pinion drive lifts for building industrial applications be particularly discussed.

As mentioned above the control of the movements of the lift car is carried through based upon information of its position. This information is obtained in the form of position impulses from a sensor device 20 (FIG. 2) in connection with the lift car arranged to indicate passage of teeth of the rack carried by the lift mast 4 or of a toothed wheel (PINION GEAR) 5 cooperating therewith. Also such a device is easily realized by the man of the art and need therefore not be described more closely here. It can, as an example, be a two phase sensor device including two inductive sensors arranged to sense the passage of a tooth and a space, respectively, of the rack or the toothed wheel. Hereby the position can be determined with an accuracy of a $\frac{1}{4}$ of the tooth pitch, simultaneously as the moving direction is sensed. In other words information regarding the position of the lift car along the hoist mast is obtained by counting the teeth of the rack of the lift mast or of a toothed wheel climbing therealong.

The micro computer system includes a programmable micro computer unit 22, included in the control and manoeuver unit 8 and with a register for position impulse numbers from the sensor device 20, inputs for receiving call impulses for up and down travel, landing destination impulses, and outputs for controlling the operation of the electric motor 6.

The programmable micro computer unit 22 furthermore includes a programming unit with an associated programming button set 42 (FIG. 3) included in the control board 9. Furthermore display means 24 and 26, respectively, for landing indication and programming, respectively, and error messages, are connected to the programmable micro computer unit.

The micro computer system furthermore includes a micro computer unit 28 ((FIGS. 1 and 2) in the ground level unit 12. The unit 28 communicates with the call button units 10 which are provided with two push-buttons, one for each direction of travel. The fixed micro computer unit 28 is, more particularly, arranged to scan the units 10 in turn with respect to their state, i.e. if a call signal is present, and the direction thereof, and store such information. Identification of the respective landings is then carried through via thumb-wheel switches or similar means, which are simple and reliable and are located in the push button box on the respective landing. When a call from a landing has been received it shall be acknowledged in that a signal lamp for the desired direction of travel is lighted on the landing in question.

The information stored in the fixed micro computer unit 28 shall be transferred to the control and manoeuver unit 8 in the lift car 2 with its micro computer unit 22. The communication between the units 22 and 28 is carried through via a transmitter/receiver unit 30 and by capacitive transmission with a loop via two phase conductors of the cable 16. This transmission is indicated at 32 and 34 in FIG. 2. Alternatively inductive transmission can be used with a loop via ground cable and lift mast. The last-mentioned principle of transmission has, however, turned out to be suspectible to problems due to the fact that the transmission at one point must pass the toothed wheel climbing on the rack and due to the inductance of the cable drum. The first indicated capactive transmission eliminates the problems with inductance at the drum and is not dependent from a perfect grounding.

By using the power cable 16 as a transmission means the need of a separate signal cable between the lift car computer 22 and the ground level computer 28 is eliminated, which provides an important simplification of the system and increases reliability. The transmission can, however, also, of course, be carried through via a separate two wire control cable, not shown. This can particularly come into question in lift installations of great height.

The function of the floor call system shall now be described more closely below while particularly attaching importance to the function of the micro computer equipment in the lift car, reference being particularly made to FIG. 3 which schematically shows, as an example, how the control board 9 of the lift car can be realized.

The board includes the above mentioned display means 24 and 26. The display means 24 shows by means of numbers the floor or landing on which the lift car 2 is located. The display means 26 is normally not switched on.

At 36 error indicating lamps are shown. The upper one of these, "COMPUTER FAILURE", is, put on if the computer system is out of operation, the other one, "DOORS", is put on if some of the floor doors or the lift door is open, and the third one, "SYSTEM ERROR", indicates connection disturbances, e.g. between the lift car computer 22 and the ground level computer 28 or between the computer 28 and the landing units 10. An impulse for open door is obtained from a closing contact in a limit switch. The lowermost button, "EMERGENCY STOP/SERVICE", has two functions. Either it is put on in case of brake error/too long brake distance, or when change of oil and service is due after a certain time of operation. Two service occasions can e.g. be programmed into the computer. Reset of this indication is obtained by means of a key operated reset button 38 in the lowermost line of the control board 9.

Of the above mentioned destination buttons 40 there shall be one for each landing. In FIG. 3 eight destination buttons 40 have been drawn as an example, but the call system can be realized for at least fifty landings. When destination is carried through this is acknowledged in that a signal lamp included in a button in question is put on.

At 42 the above mentioned button set for programming the micro computer 22 and for "questions" to the computer are shown. This button set includes ten number buttons, and seven function buttons. Of the function buttons, the button REG is used for calling a desired one of ten registers 00–09, the number of the desired register then being registered by means of said number buttons. The programming display 26 then shows the register number in question and the programmed value. The function of these registers appears from below.

| Register. | |
|---|---|
| 00 | Postion of the lift (number of teeth) |
| 01 | Stop distance up (number of teeth) |
| 02 | Stop distance down (number of teeth) |
| 03 | Change speed point |
| 04 | Max. speed allowable |
| 05 | Max. brake distance |
| 06 | Service 1 |
| 07 | Service 2 |
| 08 | Speed |
| 09 | Error messages |

Upon call of the register 00 there is shown in the programming display 26 the actual position of the lift as expressed in number of teeth, i.e. the position impulse number that is obtained from the above described sensor device 20.

In registers 01 and 02 the number of teeth are stored which correspond to the required stop distance at a landing. The length of the brake distance varies from case to case depending upon the direction of travel and the actual load. For the lift car 2 to stop exactly at the landing it is necessary that power to the drive motor 6 is switched off and brake is switched on a certain number of teeth before the lift car arrives at the landing. In the control system automatic compression for the brake distance shall therefore be included. Calculation of the length of the brake distance can be carried through either based upon the speed of the lift car for up or down travel, respectively, or a mean value of the length of the brake distances during the latest brakings during travel up and down, respectively. The micro computer system can be programmed and arranged to automatically update the actual values.

In the register 03 there is stored the number of teeth before a landing that is required for the lift car 2 to change from full to slow speed. A signal to the power equipment in the lift car keeps a control relay actuated as long as the lift car shall travel with full speed. The signal shall disappear a controllable number of impulses (teeth) before the lift car arrives at the actual landing. The lift car shall thereafter continue with slow speed to the landing.

The function of registers 04 and 05 appears directly from the table. In the registers 06 and 07 the numbers of service hours for two service occasions are programmed. When there is time for service, the fourth lamp in the table 36 is put on. Upon call of the register 08 there is indicated in the display 26 the maximum speed the lift has had between two floors. It is automatically reset for each destination. Call of the register 09 results in an error message in the display 26. Below examples of the formulation of such error messages are given.

| Error message | | |
|---|---|---|
| Results in emergency stop: | | |
| 1 | XX (attained value) | Maximum speed |
| 2 | XX (attained value) | Maximum brake distance |
| 3 | 1 | Interruption of communication with ground level |
| 4 | 1 | Emergency stop |
| 4 | 2 | Overload |
| 5 | NN | Doors, landing doors identified with 00-55; lift car doors with 80 |
| 6 | OO | Service |
| 7 | OO | Data missing |
| Does not result in emergency stop. | | |
| 8 | NN | Floor interruptions, landings identified with 00-55 |
| 8 | 61 | Inspection |
| 8 | 62 | Installation |
| 8 | 63 | Transmission error to ground level |
| 8 | 64 | Transmission error to ground level |

The button "STLE" is used for programming landing numbers. The button "LOAD" is used for introducing into the memory (in an actual register) of the computer the value that has been registered with the number buttons of button set 42 and shown in the programming display 26. The button "RESET" is used for resetting after minor errors causing stop of the lift and the button "CLR" (clear) is used for resetting the programming display 26.

Programming of the position of the landings at installation of a lift system is carried through the following way.

A key button 44, "INSTALLATION", is operated. Hereby the lift car can be operated manually by means of buttons 46 and 48, "up" and "down" (when the actual button is released the lift car is stopped.) When the lift car has reached a landing, register 00 is called and the value thereof shown in the display 26 is noted. Then the button "STLE" is pushed, and the actual landing number is pressed with the number buttons. As a result the programming display 26 shows a number of zeros. By means of the number buttons the position value (number of teeth) that was noted is registered and is thereby shown on the display 26. Finally the button "LOAD" is pushed.

The programming operations described are repeated for the actual number of landings and make possible also reprogramming of the position of one or more landings.

In case of an emergency stop impulse from a button 50 all registered operational orders shall be cancelled. Return to normal operation may happen first after reset and new destination has been carried through from the lift car. An emergency stop impulse is obtained via a closing contact of a main contactor. An emergency stop impulse can also be obtained via a landing door limit switch. Also here return to normal operation may happen first after reset has been carried through.

Below the input signals required for the function of the system will briefly be stated. The realization in practice is realized by the man of the art.

The following inputs are required:

On landings

Call impulses for travel up and down, respectively, which are received from the respective push buttons of units 10 on the landings.

Emergency stop/error impulse from emergency stop button and/or landing door limit switch.

In lift car

Destination impulse obtained from the destination buttons 40.

Counting impulses from the sensor device 20.

Emergency stop impulse.

Impulse for open car door, obtained from a closing contact in limit switch.

Emergency signal from an emergency button not shown.

A signal indicating overload. This signal is obtained from an inductive sensor or microswitch, that breaks in case of overload in the car. In case of overload it shall not be possible to start the lift. Due to acceleration forces the overload signal must momentarily be shunted as soon as the lift has started. In case of very near overload, i.e. if the lift car travels with nominal speed upwards, which is calculated based upon the teeth frequency, the lift car shall not stop to pick up more passengers, but travel to the nearest destination in order to get rid of the load soonest possible.

Acknowledgement/reset of stop and indication for emergency stop/service. This signal is obtained via the key push button 38. "Normal" emergency stops are reset in that push button/relay returns to its normal operational state, and the lift gets driving orders via destination buttons.

Disconnection of call signals from the landings. This is used in connection with inspections, service and the like, so that the lift can be operated only from inside the lift car. This signal is obtained via the switch 44, which is normally "on".

Installation driving or present driving orders cancelled. The lift car is operated by means of push buttons on the car roof directly to the operating contactors. Installation driving is used during installation of the lift mast and in case of inspection/service. The signal is obtained via switches normally "on". The system furthermore suitably works with the following output signals.

To landings

Acknowledgement on the actual landing of a received call impulse for travel upwards. A lamp or the like is kept on until the lift arrives at the landing for continued travel upwards.

Acknowledgement on an actual landing of a received call impulse for down travel. A lamp/light emitting diode is kept on until the lift arrives at the landing or continued travel down.

Indications of the direction of travel of the lift.

Emergency signal to the ground landing, which is obtained in that an emergency signal relay is actuated and lets current to an emergency signal clock.

To power equipment in lift car

Signal for travel direction up. Shall keep the direction contactor actuated as long as the control system gives direction up. Shall be "disactuated" in case of normal stop or emergency stop.

Travel direction down. Shall keep the direction contactor actuated as long as the control system gives direction down. Shall be "disactuated" at normal stop or emergency stop.

Acceleration/retardation.

Acknowledgement of received destination impulse.

Start signal, in the form of a short impulse which is emitted a few seconds before the lift starts and actuates a summer/ring bell. Also "hurry up signal" if car door or landing door is kept open more than a predetermined time, e.g. a minute.

Overload. Is indicated with a lamp/light emitting diode in the lift car.

I claim:

1. In a rack and pinion lift system, comprising a lift car, electro motor means for driving said car along a lift mast via rack and pinion means, a control unit in said car with a control buttons set including floor call buttons, call button units on landings along said mast, means connecting said call button units to said control unit via a ground level unit, the improvement comprising (A) sensor means associated with said lift car having means for sensing passage of teeth of said rack and pinion means and producing corresponding position impulses representative of the position of said lift car along said mast (B) a micro computer system comprising (a) a programmable micro computer unit in said lift car with means for receiving said position impulses, register means for position impulse numbers based upon said position impulses and representative of the positions of landings, means for collecting and storing call impulses from said call button units and destination impulses from said control button set, and output and control means for controlling operation of the electric motor as determined by received call and destination impulses.

(b) a second micro computer unit associated with said ground level unit having means for scanning said call button units with respect to their state and sending corresponding call impulses to said programmable micro computer unit.

2. A system according to claim 1, in which a power cable leading from said ground level unit to said lift car is used as communication means between said programmable micro computer unit and said second micro computer unit.

3. A system according to claim 1, wherein the programmable micro computer unit includes programming means enabling re-programming of said register means in case of change of the number and positions of the landings.

4. A system according to claim 3, wherein said reprogramming means includes a programming pushbutton set.

5. A system according to any of claims 1–4, wherein the programmable micro computer unit includes registers for the number of teeth of said rack and pinion means before a landing where the lift car shall change speed from full to low, for the number of teeth before a landing that corresponds to stop distance, and for the number of teeth corresponding to maximum allowed brake distance, there being arranged that if the last-mentioned number of teeth is exceeded the lift shall make an emergency stop and error indication for brake error be given.

6. A system according to claim 1, wherein said programmable micro computer unit includes a register for service intervals in number of hours, and means for indicating when such service is due.

7. A system according to claim 2, wherein the communication via the power cable is carried through by means of capacitive transmission with a loop via two phase leaders of the power cable.

8. A system according to claim 1, wherein the sensor device includes two inductive sensors for sensing passage of teeth and spaces, respectively, of said rack and pinion means.

* * * * *

UNITED STATES PATENT AND TRADEMARK OFFICE

CERTIFICATE OF CORRECTION

PATENT NO. : 4,440,266

DATED : April 3, 1984

INVENTOR(S) : ULF KOHLER

It is certified that error appears in the above-identified patent and that said Letters Patent are hereby corrected as shown below:

Column 1, line 20, "corrasive" should read --corrosive--.

Column 7, line 20, "landing or" should read --landing for--.

Signed and Sealed this

*Nineteenth* Day of *February 1985*

[SEAL]

*Attest:*

DONALD J. QUIGG

*Attesting Officer* *Acting Commissioner of Patents and Trademarks*